US009255668B2

(12) United States Patent
Ye et al.

(10) Patent No.: US 9,255,668 B2
(45) Date of Patent: Feb. 9, 2016

(54) BASE, ROUND TUBE HOUSING AND LAMP INCLUDING BASE AND ROUND TUBE HOUSING

(71) Applicant: OSRAM GmbH, Munich (DE)

(72) Inventors: Zesheng Ye, Shenzhen Guangdong (CN); Nimchung Ku, Shenzhen Guangdong (CN); Middel Tjaco, Shenzhen Guangdong (CN); Quansheng Liu, Shenzhen Guangdong (CN)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/347,244

(22) PCT Filed: Sep. 25, 2012

(86) PCT No.: PCT/EP2012/068861

§ 371 (c)(1),
(2) Date: Mar. 26, 2014

(87) PCT Pub. No.: WO2013/045439

PCT Pub. Date: Apr. 4, 2013

(65) Prior Publication Data

US 2014/0240972 A1 Aug. 28, 2014

(30) Foreign Application Priority Data

Sep. 27, 2011 (CN) ..... 2011 1 0304989

(51) Int. Cl.
*F21S 4/00* (2006.01)
*F21K 99/00* (2010.01)

(Continued)

(52) U.S. Cl.
CPC . *F21K 9/175* (2013.01); *F21K 9/17* (2013.01); *F21V 15/01* (2013.01); *F21V 19/004* (2013.01);

(Continued)

(58) Field of Classification Search
CPC ..... F21Y 2103/003; F21V 19/004; F21V 19/003; F21K 9/17; F21K 9/175
USPC ..... 362/217.01
See application file for complete search history.

(56) References Cited

U.S. PATENT DOCUMENTS 8,360,599 B2 * 1/2013 Ivey et al. ..... 362/218
8,419,211 B2 * 4/2013 Chi ..... F21V 19/004 362/217.1

(Continued)

FOREIGN PATENT DOCUMENTS

CN 201259099 Y 6/2009
DE 202010013037 U1 3/2011

(Continued)

OTHER PUBLICATIONS

English abstract of CN 201259099 Y dated Jun. 17, 2009.

(Continued)

*Primary Examiner* — Peggy Neils
(74) *Attorney, Agent, or Firm* — Viering, Jentschura & Partner

(57) ABSTRACT

A base configured to carry a light emitting body and to be inserted into a round tube housing, may include: a rectangular portion configured to carry the light emitting body on a first surface of the rectangular portion; and first and second fixing portions configured to extend from first and second long edges of the rectangular portion respectively in a space that a second surface of the rectangular portion faces, such that when the base is inserted into the round tube housing, at least a part of each of the first and second fixing portions presses against the inner wall of the round tube housing, and a first part close to the first long edge and a second part close to the second long edge in the first surface of the rectangular portion press against first and second protrusions on the inner wall of the round tube housing respectively.

10 Claims, 3 Drawing Sheets

(51) Int. Cl.

| | |
|---|---|
| ***F21V 19/00*** | (2006.01) |
| ***F21V 15/01*** | (2006.01) |
| ***F21V 29/70*** | (2015.01) |
| ***F21V 29/71*** | (2015.01) |
| ***F21V 29/87*** | (2015.01) |
| ***F21V 29/89*** | (2015.01) |
| *F21Y 101/02* | (2006.01) |
| *F21Y 103/00* | (2006.01) |
| *F21V 29/507* | (2015.01) |

(52) U.S. Cl.

CPC ..... *F21V 19/0045* (2013.01); *F21V 29/70* (2015.01); *F21V 29/713* (2015.01); *F21V 29/87* (2015.01); *F21V 29/89* (2015.01); *F21V 29/507* (2015.01); *F21Y 2101/02* (2013.01); *F21Y 2103/003* (2013.01)

(56) References Cited

U.S. PATENT DOCUMENTS

| | | | | |
|---|---|---|---|---|
| 2004/0252501 | A1 | 12/2004 | Moriyama et al. | |
| 2010/0008085 | A1* | 1/2010 | Ivey et al. | 362/218 |
| 2011/0090682 | A1* | 4/2011 | Zheng et al. | 362/218 |
| 2011/0141724 | A1* | 6/2011 | Erion | 362/218 |

FOREIGN PATENT DOCUMENTS

| | | | |
|---|---|---|---|
| JP | 2010129382 | A | 6/2010 |
| WO | 2011075116 | A1 | 6/2011 |
| WO | 2011086906 | A1 | 7/2011 |

OTHER PUBLICATIONS

English abstract of JP 2010129382 A dated Jun. 10, 2010.
International Search Report issued in the corresponding PCT application No. PCT/EP2012/068861, dated Jan. 24, 2013.

* cited by examiner

BASE, ROUND TUBE HOUSING AND LAMP INCLUDING BASE AND ROUND TUBE HOUSING

RELATED APPLICATIONS

The present application is a national stage entry according to 35 U.S.C. §371 of PCT application No.: PCT/EP2012/068861 filed on Sep. 25, 2012, which claims priority from Chinese application No.: 201110304989.1 filed on Sep. 27, 2011, and is incorporated herein by reference in its entirety.

TECHNICAL FIELD

Various embodiments relate to the illumination field, and particularly to a base, round tube housing, and a lamp including the base and round tube.

BACKGROUND

With the development of Light-Emitting Diode (referred to as LED for short) illumination technology, more and more customers want to take advantage of benefits of LEDs, such as controllable color and controllable brightness of the LED. Now, more and more companies are developing LED tubes to replace fluorescent lamps (referred to as FL for short). For the developed LED tube, a plastic tube is widely used. However, the plastic tube has the following disadvantages: the plastic tends to bend, especially for a long tube, in which the bending is considerable; and the LED overheats due to poor thermal conductivity of the plastic tube, which causes the lifetime of the LED tube to shorten.

FIG. 1 schematically illustrates a cross section view of a main body of an LED lamp according to related art. As shown in FIG. 1, the main body of the LED lamp includes an upper housing 1*a*, a lower housing 1*b*, a Printed Circuit Board (referred to as PCB for short) 3, and an LED 2, etc. The plastic upper housing 1*a* has a right end portion 1*a-a* and a left end portion 1*a-b* having wedged sections, and the plastic lower housing 1*b* has a right end portion 1*b-a* and a left end portion 1*b-b* having concave sections. Since FIG. 1 is only a cross section view, in fact, the main body of the LED lamp may extend for a certain length in a direction perpendicular to the paper. The right end portion 1*a-a* of the plastic upper housing 1*a* and the right end portion 1*b-a* of the plastic lower housing 1*b* are joined, and the left end portion 1*a-b* of the plastic upper housing 1*a* and the left end portion 1*b-b* of the plastic lower housing 1*b* are joined. Since the upper housing 1*a* and the lower housing 1*b* are joined by only inserting the wedged right end portion 1*a-a* into the concave right end portion 1*b-a* and inserting the wedged left end portion 1*a-b* into the concave right end portion 1*b-a*, the joint between the upper housing 1*a* and the lower housing 1*b* is not tight and may loosen easily. In addition, since the main body of the LED lamp may extend for a certain length in a direction perpendicular to the paper and the upper housing 1*a* and the lower housing 1*b* are both made of plastic, the main body of the LED lamp tends to bend. Further, since the upper housing 1*a* and the lower housing 1*b* are both made of plastic, the LED tends to overheat, which may shorten the lifetime of the LED lamp.

Therefore, there is need for a technique capable of solving the above problem.

SUMMARY

Various embodiments provide a base, round tube housing and lamp including the base and the round tube housing.

According to one aspect of the embodiment, a base is provided, configured to carry a light emitting body and to be inserted into a round tube housing, the base including: a rectangular portion configured to carry a light emitting body on a first surface of the rectangular portion; and first and second fixing portions configured to extend from a first and second long edge of the rectangular portion respectively in a space that a second surface of the rectangular portion faces, such that when the base is inserted into the round tube housing, at least a part of each of the first and second fixing portions presses against the inner wall of the round tube housing, and a first part close to the first long edge and a second part close to the second long edge in the first surface of the rectangular portion press against first and second protrusions on the inner wall of the round tube housing respectively.

According to another aspect of the embodiment, a round tube housing is provided, configured to have the base inserted therein and including: first and second protrusions extending toward each other on the inner wall of the round tube housing along an axial surface of the round tube housing or along a plane parallel to the axial surface; and when the base is inserted into the round tube housing, the inner wall of the round tube housing presses against at least a part of each of the first and second fixing portions of the base, and the first and second protrusions press against a first part close to the first long edge and a second part close to the second long edge in the first surface of the rectangular portion of the base, respectively.

According to still another aspect of the embodiment, a lamp is provided, including: the base and the round tube housing, a light emitting body arranged on the first surface of the rectangular portion of the base, a drive part for driving the light emitting body, a first end cap arranged at a first axial end of the round tube housing, and a second end cap arranged at a second axial end of the round tube housing.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

A base 5 and a round tube housing 1' according to an embodiment of the disclosure are described hereinafter by referring to FIGS. 2 to 4.

Figure 1:
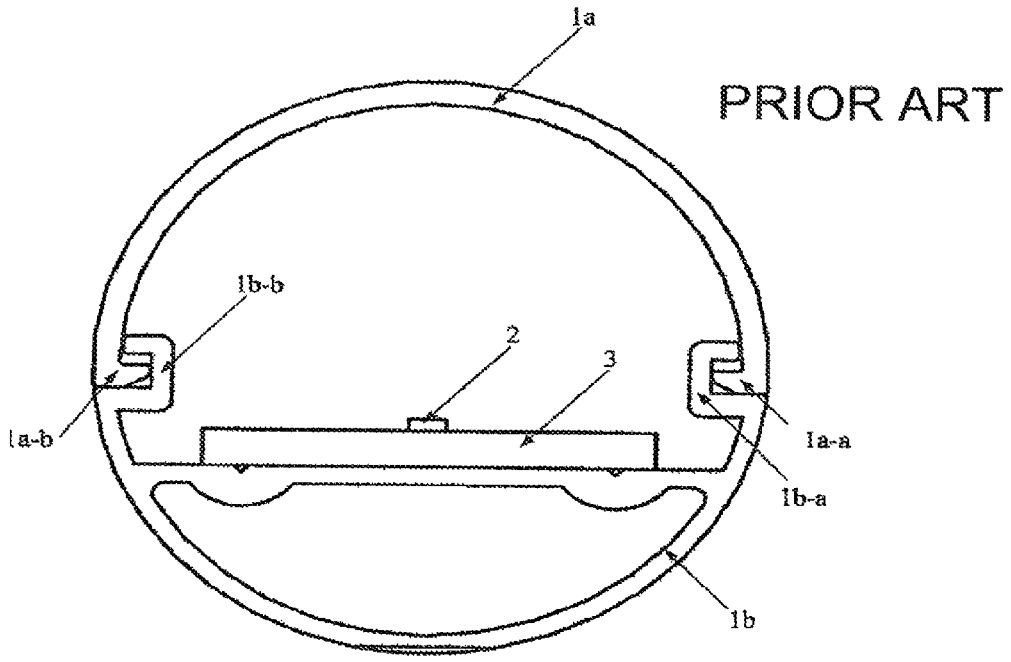
FIG. 1 illustrates schematically a cross section view of a main body of an LED lamp according to related art.
Figure 2:
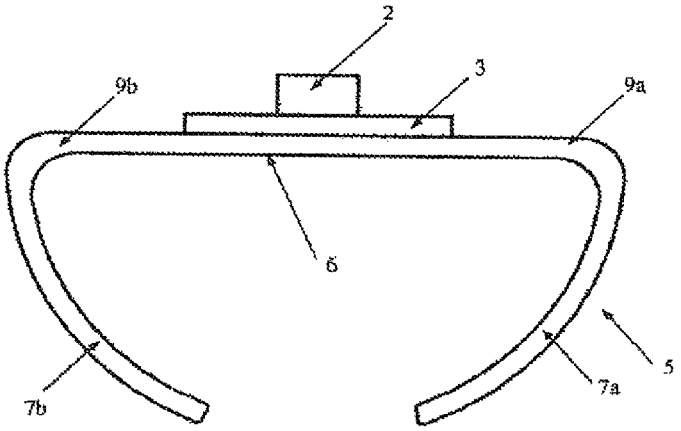
FIG. 2 illustrates schematically a cross section view of a base according to an embodiment of the disclosure.
Figure 3:
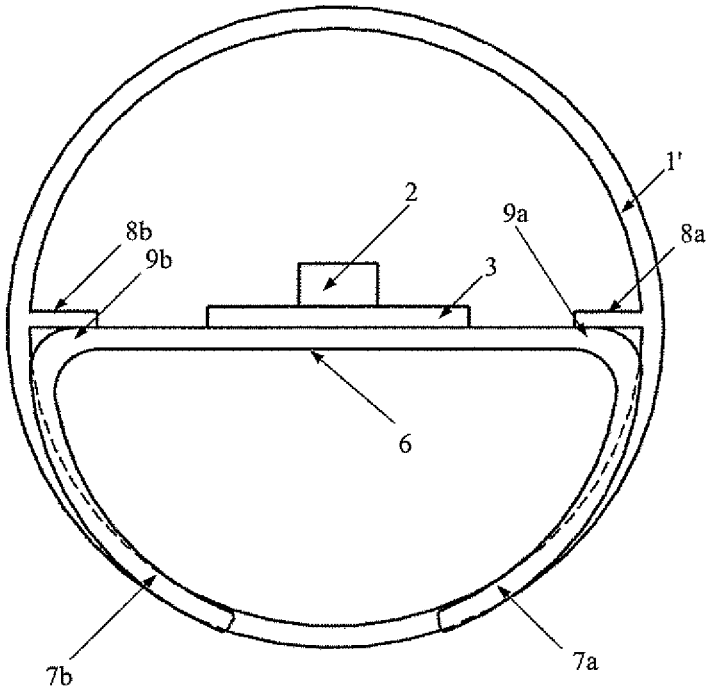
FIG. 3 illustrates schematically a cross section view of the base and the round tube housing according to the embodiment of the disclosure before being matched.
Figure 4:
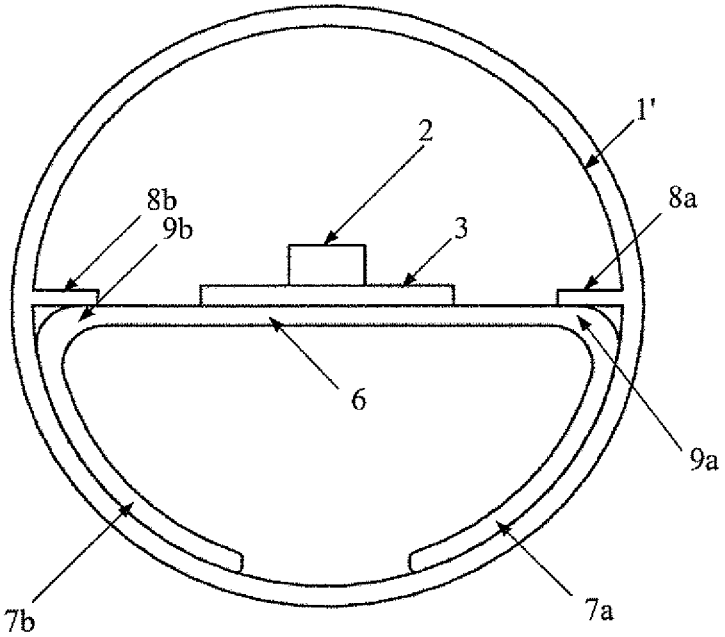
FIG. 4 illustrates schematically a cross section view of the base and the round tube housing according to the embodiment of the disclosure after being matched.

FIG. 2 illustrates schematically a cross section view of the base 5 according to the embodiment of the disclosure, FIG. 3 illustrates schematically a cross section view of the base 5 and the round tube housing 1' according to the embodiment of the disclosure before being matched, and FIG. 4 illustrates schematically a cross section view of the base 5 and the round tube housing 1' according to the embodiment of the disclosure after being matched.

As shown in FIGS. 2 to 4, the base 5 includes a rectangular portion 6, a right fixing portion 7*a* and a left fixing portion 7*b*.

Since FIGS. 2 to 4 are cross section views, the rectangular portion 6 extends for a certain length, i.e., the length of long edges of the rectangular portion, along a direction perpendicular to the paper.

A light emitting body is carried on an upper surface of the base 6. For example, in the example shown in FIGS. 2 to 4, the light emitting body consists of a PCB 3 and a plurality of LEDs 2. However, it should be understood that the light emitting body consisting of the PCB 3 and the plurality of LEDs 2 is only an example. As desired, the light emitting body may be any other light emitting component.

The right fixing portion 7*a* extends from the right edge of the rectangular portion 6, and the left fixing portion 7*b* extends from the left edge of the rectangular portion 6. When the base 6 is inserted into the round tube housing 1', each of the right fixing portion 7*a* and the left fixing portion 7*b* presses against the inner wall of the round tube housing 1', and a part 9*a* close to the right edge in the upper surface of the rectangular portion 6 and a lower surface of a right protrusion 8*a* on the inner wall of the round tube housing 1' press against each other, a part 9*b* close to the left edge in the upper surface of a rectangular portion 6 and a lower surface of a left protrusion 8*b* on the inner wall of the round tube housing 1' press against each other, as shown in FIGS. 3 and 4.

The right protrusion 8*a* and left protrusion 8*b* each extend towards each other on the inner wall of the round tube housing 1' along the axial surface of the round tube housing 1' or a plane parallel to the axial surface, as shown in FIGS. 3 and 4.

In the example shown in FIG. 2, the cross sections of the right fixing portion 7*a* and the left fixing portion 7*b* are of arc shapes having a curvature less than that of the round cross section of the round tube housing 1'. For example, the curvature of the arc shape of the right fixing portion 7*a* and the left fixing portion 7*b* may be slightly less than that of the round cross section of the round tube housing 1', such that the base 5 can be easily inserted into the round tube housing 1', and the pressing force between each of the right fixing portion 7*a* and the left fixing portion 7*b* and the round tube housing 1' is relatively small. Alternatively, the curvature of the arc shape of the right fixing portion 7*a* and the left fixing portion 7*b* may be much less than that of the round cross section of the round tube housing 1', such that right fixing portion 7*a* and left fixing portion 7*b* of the base 5 need to be bent more when inserted into the round tube housing 1', and the pressing force between each of the right fixing portion 7*a* and the left fixing portion 7*b* and the round tube housing 1' may increase accordingly.

The cross section of the right fixing portion 7*a* and the left fixing portion 7*b* may not necessarily be of arc shape. For example, in a cross section view, the right fixing portion 7*a* and the rectangular portion 6 may form a certain angle (for example, 90 degrees), and the cross section of the right fixing portion 7*a* may be of a straight plate shape (not shown), while the cross section of the left fixing portion 7*b* may be of a circular arc shape (as shown in FIGS. 2 and 3). Alternatively, in a cross section view, the left fixing portion 7*b* and the rectangular portion 6 may form a certain angle (for example, 90 degrees), and the cross section of the left fixing portion 7*b* may be of a straight plate shape (not shown), while the cross section of the right fixing portion 7*a* may be of a circular arc shape (as shown in FIGS. 2 and 3). Alternatively, the right fixing portion 7*a* and the left fixing portion 7*b* each extend from the respective edge of the rectangular portion 6, and the cross sections of the right fixing portion 7*a* and the left fixing portion 7*b* are both of a straight plate shape (not shown). It may be understood that if the cross sections of the right fixing portion 7*a* and the left fixing portion 7*b* are both of a straight plate shape, when the base 5 is inserted into the round tube housing 1', the right fixing portion 7*a* and the left fixing portion 7*b* may not contact with the round tube housing 1' sufficiently. In other words, the contact area between the right fixing portion 7*a* and the inner wall of the round tube housing 1' and the contact area between the left fixing portion 7*b* and the inner wall of the round tube housing 1' may be of linear shape. The contact areas of linear shape can still fix stably the base 5 to the round tube housing 1'.

It may be understood that the right fixing portion 7*a* and the left fixing portion 7*b* may be of other shapes, even of irregular shapes, as long as at least a part of each of the right fixing portion 7*a* and the left fixing portion 7*b* presses against the inner wall of the round tube housing 1', and a part 9*a* close to the right long edge and a part 9*b* close to the left long edge in the upper surface of the rectangular portion 6 press against a right protrusion 8*a* and a left protrusion 8*b* on the inner wall of the round tube housing 1', respectively.

Preferably, the rectangular portion 6, right fixing portion 7*a* and left fixing portion 7*b* may be formed integrally. Optionally, the rectangular portion 6, right fixing portion 7*a* and left fixing portion 7*b* may be formed separately, then be joined, bonded or welded together.

In addition, the round tube housing 1' may be manufactured by an extrusion process. The round tube housing 1' may be made of appropriate material, for example, plastic (such as polycarbonate, polymethyl methacrylate, etc.).

Preferably, the rectangular portion 6, right fixing portion 7*a* and left fixing portion 7*b* may be formed of metal such as copper, iron etc. For example, a metal sheet may be bent into the shape of the base 5 by a bending process.

Of course, the rectangular portion 6, right fixing portion 7*a* and left fixing portion 7*b* may be formed of other appropriate materials, for example, plastic (such as polycarbonate, polymethyl methacrylate etc.). For example, the plastic may be manufactured into the shape of the base 5 by an extrusion process.

A lamp L including a base 5 and a round tube housing 1' according to the embodiment of the disclosure will be described hereinafter by referring to FIG. 5.

Figure 5:
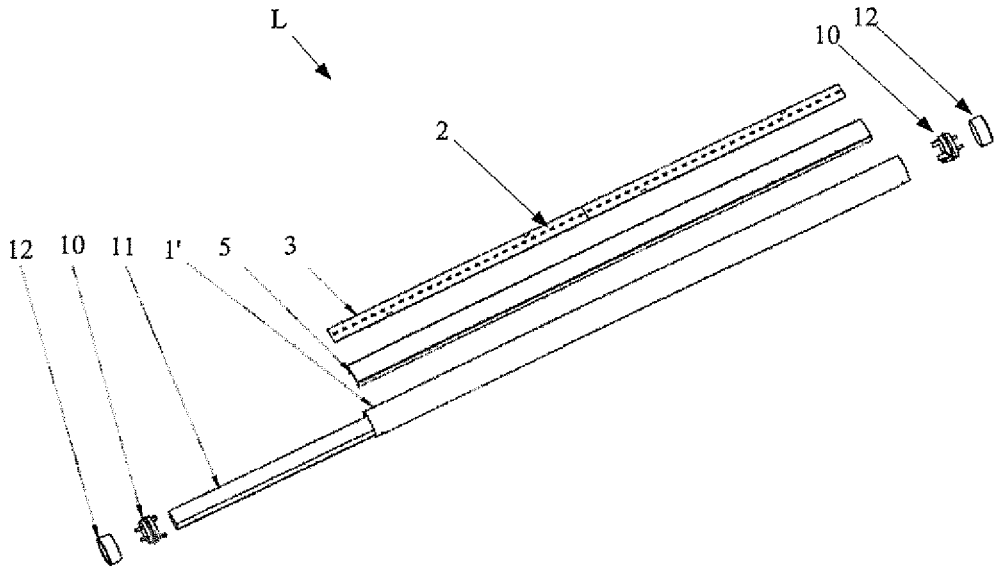
FIG. 5 illustrates schematically an exploded view of a lamp including the base and round tube housing according to the embodiment of the disclosure.

FIG. 5 is an exploded view illustrating schematically the lamp L including the base 5 and the round tube housing 1' according to the embodiment of the disclosure. As shown in FIG. 5, the lamp L may include the round tube housing 1', the base 5, a light emitting body (for example, PCB 3 on which a plurality of LEDs 2 are mounted) arranged on the rectangular portion of the base 5, a drive 11 for driving the light emitting body, and two end caps 10. In the mounted lamp L, each of the two end caps 10 is arranged at a respective axial end of the round tube housing 1'.

Optionally, the lamp L as shown in FIG. 5 may further include two rings 12 which may cover the internal structure of the end caps 10 and make the lamp L look better.

Although the light emitting body in lamp L shown in FIG. 5 is the PCB 3 on which the plurality of LEDs 2 are mounted, as desired, the light emitting body may be any other appropriate light emitting component.

Although the base 5 may have longer size, since the base 5 has one rectangular portion 6 and the two fixing portions (that is, the right fixing portion 7*a* and left fixing portion 7*b*), the base portion 5 will not tend to bend either before or after the base portion 5 is inserted into the round tube housing 1'.

In addition, in the case where the base 5 is made of metal, since the thermal conductivity of metal is high, metal may conduct heat from the light emitting body (for example the light emitting body including the LEDs 2 and PCB 3) to the round tube housing 1' such that the heat will not gather in the vicinity of the light emitting body. By way of such a design, the lifetime of the light emitting body will be prolonged.

In the case where the cross sections of the right fixing portion 7*a* and the left fixing portion 7*b* are both of arc shape, since the contact surface areas between each of the right fixing portion 7*a* and the left fixing portion 7*b* and the round tube housing 1' are relatively big, the base 5 may be fixed to the round tube housing 1' better, and more heat from the light emitting body may be conducted to the round tube housing 1'. By way of such a design, the lifetime of the light emitting body will be further prolonged.

In the Description, expressions such as "first", "second", "Nth" etc. are intended to distinguish the described features literally to describe the disclosure clearly. Therefore, they should not be regarded as having any restrictive meaning.

Although the present disclosure and its advantages have been described in detail, it should be understood that various changes, substitutions and alterations can be made herein without departing from the spirit and scope of the disclosure as defined by the appended claims. Moreover, the scope of the present disclosure is not limited to the particular embodiments of the process, device, means, methods and steps described in the Description. As one of ordinarily skill in the art will readily appreciate from the disclosure contained in the disclosure, processes, devices, means, methods or steps currently existing or later to be developed, that perform substantially the same function or achieve substantially the same result as the corresponding embodiments described herein, may be utilized according to the present disclosure. Accordingly, the appended claims are intended to include within their scope such processes, devices, means, methods, or steps.

The invention claimed is:

1. A base configured to carry a light emitting body and to be inserted into a round tube housing, the base comprising:

a rectangular portion configured to carry the light emitting body on a first surface of the rectangular portion; and first and second fixing portions configured to extend from first and second long edges of the rectangular portion respectively in a space that a second surface of the rectangular portion faces, such that when the base is inserted into the round tube housing, at least a part of each of the first and second fixing portions presses against the inner wall of the round tube housing, and a first part close to the first long edge and a second part close to the second long edge in the first surface of the rectangular portion press against first and second protrusions on the inner wall of the round tube housing respectively.

2. The base as claimed in claim 1, wherein the cross section of at least one of the first and second fixing portions taken along a plane parallel to a short edge of the rectangular portion is of arc shape, and the arc has a curvature less than that of the cross section of the round tube housing.

3. The base as claimed in claim 1, wherein the rectangular portion, the first fixing portion and the second fixing portion are formed integrally.

4. The base as claimed in claim 1, wherein the rectangular portion, the first fixing portion and the second fixing portion are made of metal.

5. The base as claimed in claim 4, wherein the metal is copper or iron.

6. The base as claimed in claim 1, wherein the rectangular portion, the first fixing portion and the second fixing portion are made of plastic.

7. The base as claimed in claim 6, wherein the plastic is polycarbonate or polymethyl methacrylate.

8. A round tube housing configured to have a base, the base comprising:

a rectangular portion configured to carry a light emitting body on a first surface of the rectangular portion; and first and second fixing portions configured to extend from first and second long edges of the rectangular portion respectively in a space that a second surface of the rectangular portion faces, such that when the base is inserted into the round tube housing, at least a part of each of the first and second fixing portions presses against an inner wall of the round tube housing, and a first part close to the first long edge and a second part close to the second long edge in the first surface of the rectangular portion press against first and second protrusions on the inner wall of the round tube housing respectively, the round tube housing, comprising:

first and second protrusions extending toward each other on the inner wall of the round tube housing along the axial surface of the round tube housing or along a plane parallel to the axial surface; and when the base is inserted into the round tube housing, the inner wall of the round tube housing presses against at least a part of each of the first and second fixing portions of the base, and the first and second protrusions press against a first part close to the first long edge and a second part close to the second long edge in a first surface of the rectangular portion of the base respectively.

9. A lamp comprising;

a base the base comprising:

a rectangular portion configured to carry a light emitting body on a first surface of the rectangular portion; and first and second fixing portions configured to extend from first and second long edges of the rectangular portion respectively in a space that a second surface of the rectangular portion faces, such that when the base is inserted into the round tube housing, at least a part of each of the first and second fixing portions presses against an inner wall of the round tube housing, and a first part close to the first long edge and a second part close to the second long edge in the first surface of the rectangular portion press against first and second protrusions on the inner wall of the round tube housing respectively;

a round tube housing the round tube housing comprising:

the base, first and second protrusions extending toward each other on the inner wall of the round tube housing along the axial surface of the round tube housing or along a plane parallel to the axial surface; and when the base is inserted into the round tube housing, the inner wall of the round tube housing presses against at least a part of each of the first and second fixing portions of the base, and the first and second protrusions press against a first part close to the first long edge and a second part close to the second long edge in a first surface of the rectangular portion of the base respectively;

the light emitting body arranged on the first surface of the rectangular portion of the base;

a drive part for driving the light emitting body;

a first end cap arranged at a first axial end of the round tube housing; and a second end cap arranged at a second axial end of the round tube housing.

10. The lamp as claimed in claim 9, wherein the light emitting body is a printed circuit board on which light emitting diodes are mounted.

* * * * *